US008290623B2

(12) United States Patent
Yan

(10) Patent No.: US 8,290,623 B2
(45) Date of Patent: Oct. 16, 2012

(54) INCLINE SENSING MODULE FOR AN AUTOMATIC CLEANER

(76) Inventor: Jason Yan, Tucheng (TW)

( * ) Notice: Subject to any disclaimer, the term of this patent is extended or adjusted under 35 U.S.C. 154(b) by 176 days.

(21) Appl. No.: 12/805,249

(22) Filed: Jul. 21, 2010

(65) Prior Publication Data

US 2011/0245972 A1 Oct. 6, 2011

(30) Foreign Application Priority Data

Mar. 30, 2010 (TW) ..... 99205573 U

(51) Int. Cl.
*G05B 15/00* (2006.01)

(52) U.S. Cl. ..... 700/258; 700/245; 700/59; 700/256; 340/436; 73/866; 701/25

(58) Field of Classification Search ..... 700/245, 700/247, 258; 439/137, 296; 307/143; 200/43.05, 200/51.16; 16/29, 30, 31, 33, 34, 37, 38, 16/41, 45, 18 R; 403/353; 73/866; 37/439
See application file for complete search history.

(56) References Cited

U.S. PATENT DOCUMENTS 5,204,814 A * 4/1993 Noonan et al. ..... 701/25
7,024,278 B2 * 4/2006 Chiappetta et al. ..... 700/245
2007/0271004 A1 * 11/2007 Kim et al. ..... 700/245
* cited by examiner

*Primary Examiner* — Behrang Badii
*Assistant Examiner* — Kevin P Mahne
(74) *Attorney, Agent, or Firm* — Bacon & Thomas, PLLC

(57) ABSTRACT

A sensing escape device of an automatic cleaner includes a control module, a motion module and an inclination limitation sensing module. The control module controls the motion module to drive the movement of the automatic cleaner in mode between a forward mode with head portion as a head and a backward mode with tail portion as a head. The inclination limitation sensing module coupled to the control module includes a critical inclination angle sensing unit outward disposed on a rear bottom of the main body. When the critical inclination angle sensing unit is externally contacted, the inclination limitation sensing module generates a signal and transfers the signal to the control module, to make the control module drive the motion module to switch into the backward mode. The automatic cleaner moves backward immediately when climbing a ramp, to avoid misjudging actions such as a suspension of the motor-driven wheel unit.

7 Claims, 8 Drawing Sheets

INCLINE SENSING MODULE FOR AN AUTOMATIC CLEANER

FIELD OF THE INVENTION

The present invention relates an automatic cleaner, and more particularly to incline sensing module disposed on an automatic cleaner for immediately activating a backward mode when climbing a ramp.

BACKGROUND OF THE INVENTION

Automatic cleaners, utilizing the technology of artificial intelligence robots, are home appliances that have a function of floor cleaning. People who use the automatic cleaners are increasing due to the decreasing sale price of the automatic cleaners.

In view of an automatic cleaner, there is a gap between the floor and a bottom of a main body of the automatic cleaner. During operation, the automatic cleaner will climb up through a ramp bump to a higher level or surmount an obstacle when facing a bump or obstacles not in touch with the front bumper. However, after arriving at the highest level of the bump with ramp or obstacle, the automatic cleaner will face a dilemma that it can not return to its original place, due to the blocking of the front bumper. Furthermore, when the automatic cleaner surmounts the obstacle, it may cause a motor-driven wheel unit suspended in midair, and thus the automatic cleaner will not be able to move forward. Not only will it interrupt the operation, but it will cause severe power consumption, resulting in waste and inconvenience.

The present invention has arisen to obviate the afore-described disadvantages, and will make the automatic cleaner operate smoothly.

SUMMARY OF THE INVENTION

A primary object of the present invention is to provide an incline sensing module of an automatic cleaner, wherein a critical inclination angle sensing unit is disposed on a rear bottom of a main body of the automatic cleaner. When the critical inclination angle sensing unit is externally contacted, it will activate a backward mode, which controls the automatic cleaner to move backward immediately when climbing a ramp, to prevent from misjudging actions such as a suspension of the motor-driven wheel unit, or from being unable to return to the original floor when climbing across a bump. It will make the automatic cleaner operate smoothly.

Another object of the present invention is to provide an incline sensing module of an automatic cleaner, wherein the critical inclination angle sensing unit is allowed, through a fastener, to be assembled or disassembled on an assembly port in the rear bottom of the main body. Users decide the automatic cleaner having a sensing escaping function or not, according to their practical demands, which allows the installation of an automatic cleaner more flexible.

To achieve the above objects, the present invention discloses an incline sensing module disposed on the main body of the automatic cleaner, wherein the two ends of the main body are a head portion and a tail portion, respectively. The incline sensing module includes a control module, a motion module and an inclination limitation sensing module. The motion module is coupled to the control module and is equipped with a motor-driven wheel unit disposed on the bottom of the main body, for controlling the movement of the automatic cleaner in mode between a forward mode with head portion as a head and a backward mode with tail portion as a head. The inclination limitation sensing module is coupled to the control module, and includes the critical inclination angle sensing unit which is outward disposed on the rear bottom of the main body. The distance between the critical inclination angle sensing unit and the bottom of the main body is smaller than the distance between the motor-driven wheel unit and the bottom of the main body. When the critical inclination angle sensing unit is externally contacted, the inclination limitation sensing module will generate a signal and transfer the signal to the control module, to make the control module drive the motion module changing into the backward mode.

To be more specifically, the critical inclination angle sensing unit is equipped with the fastener, and the bottom of the main body is equipped with the assembly port. The structure of the fastener and that of the assembly port are fitted with each other, and it allows the critical inclination angle sensing unit to be assembled or disassembled on an assembly port of the main body.

The structure and the technical means adopted by the present invention to achieve the above and other objects can be best understood by referring to the following detailed description of the preferred embodiments and accompanying drawings.

DETAILED DESCRIPTION OF THE EMBODIMENT(S)

The present invention provides an incline sensing module of an automatic cleaner, to give the automatic cleaner a sensing escaping function, so as to move backward immediately when climbing a ramp, to prevent from misjudging actions such as a suspension of the motor-driven wheel unit, or from being unable to return to the original floor.

Figure 1:
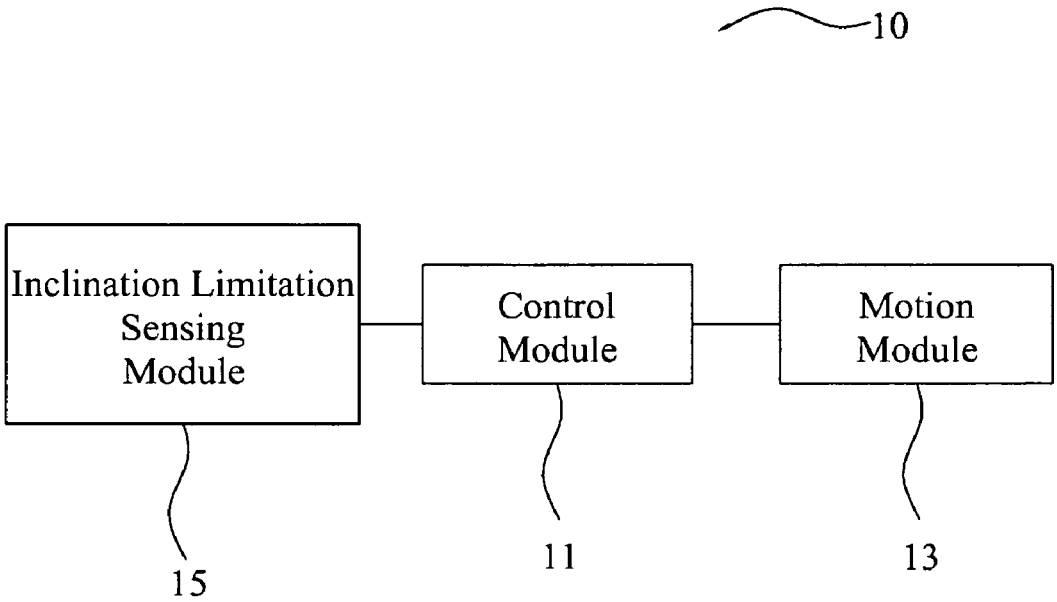
FIG. 1 is a schematic view showing the system structure of the incline sensing module of the automatic cleaner in accordance with the present invention.
Figure 2:
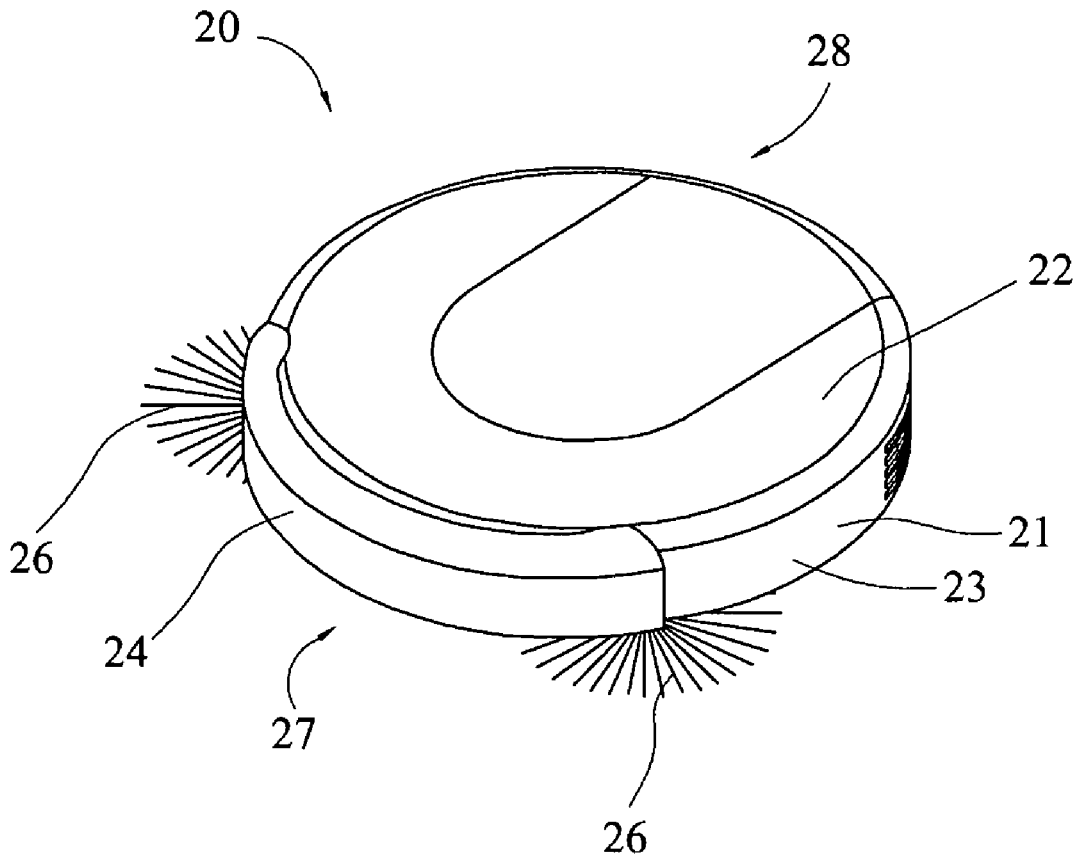
FIG. 2 is a perspective view of the automatic cleaner in accordance with the present invention.
Figure 3:
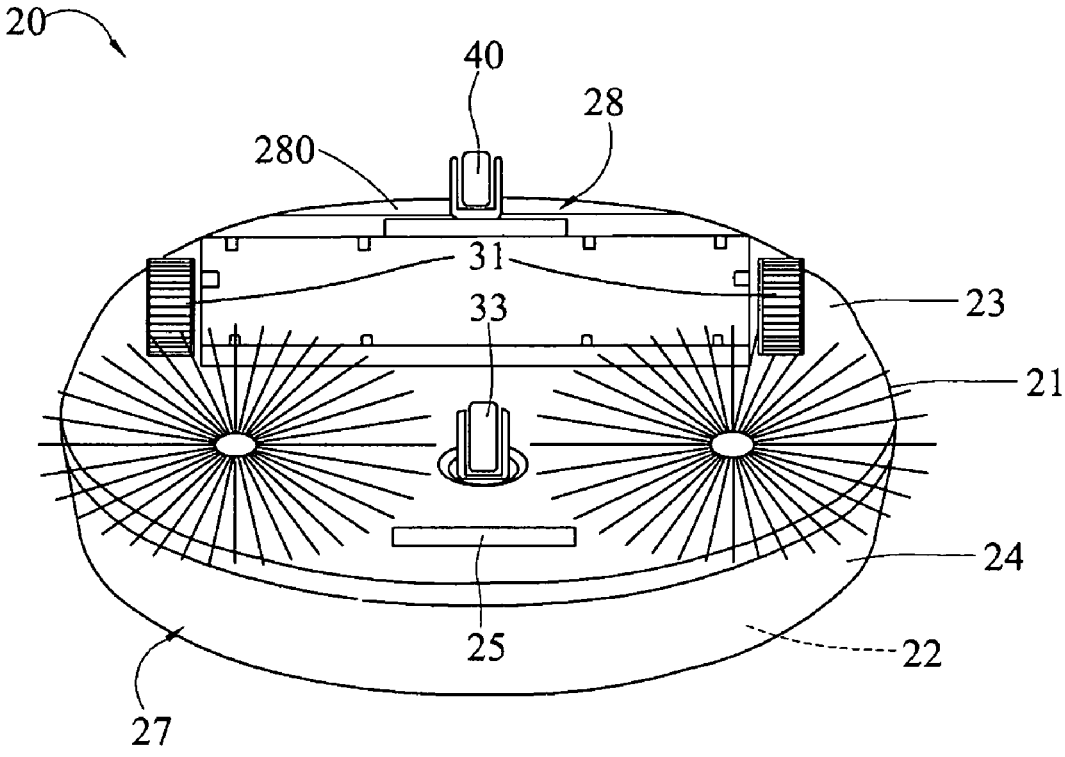
FIG. 3 is a perspective view with another viewpoint of the automatic cleaner in accordance with the present invention.
Figure 4:
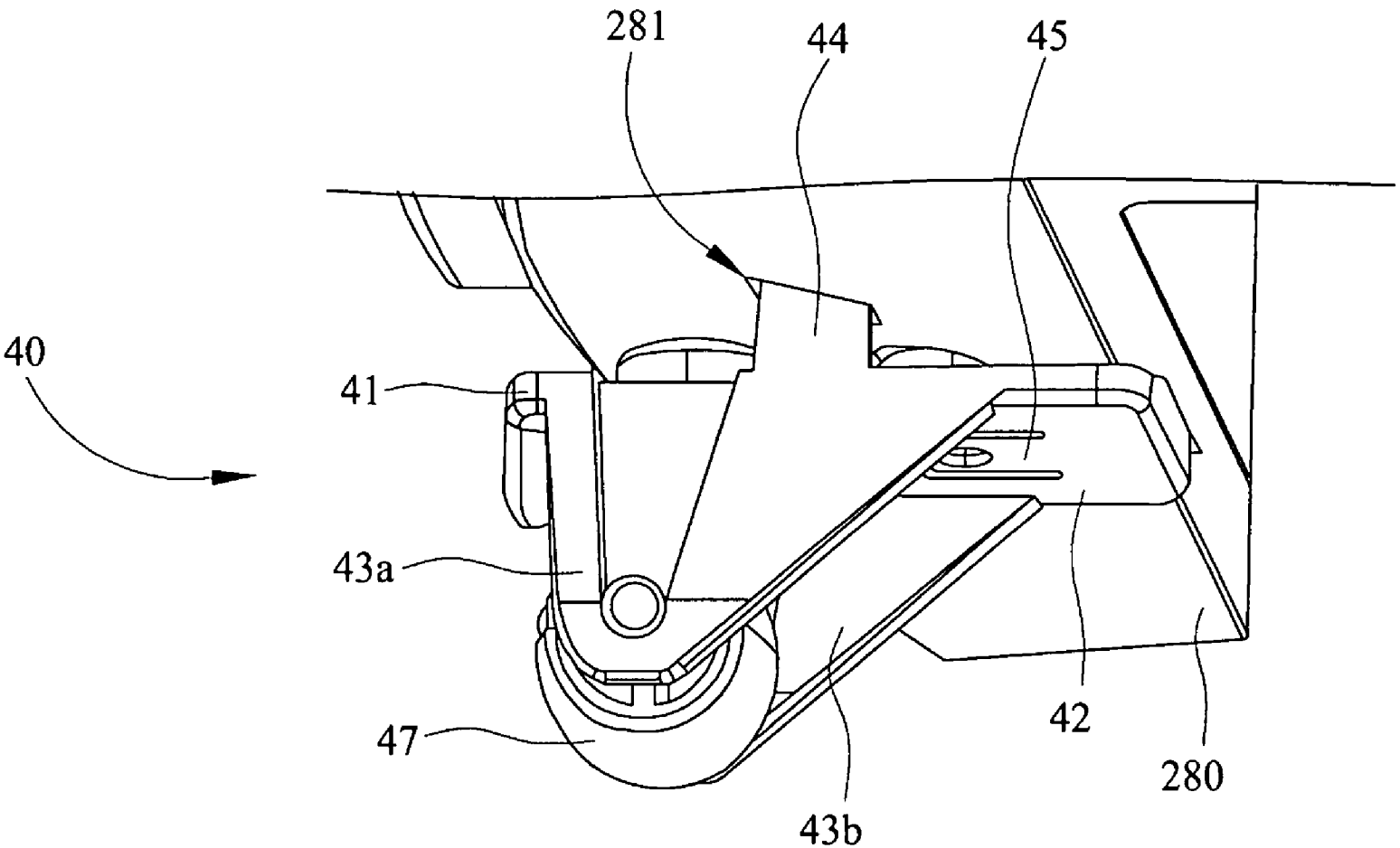
FIG. 4 is an enlarged view of the critical inclination angle sensing unit of FIG. 3.
Figure 5:
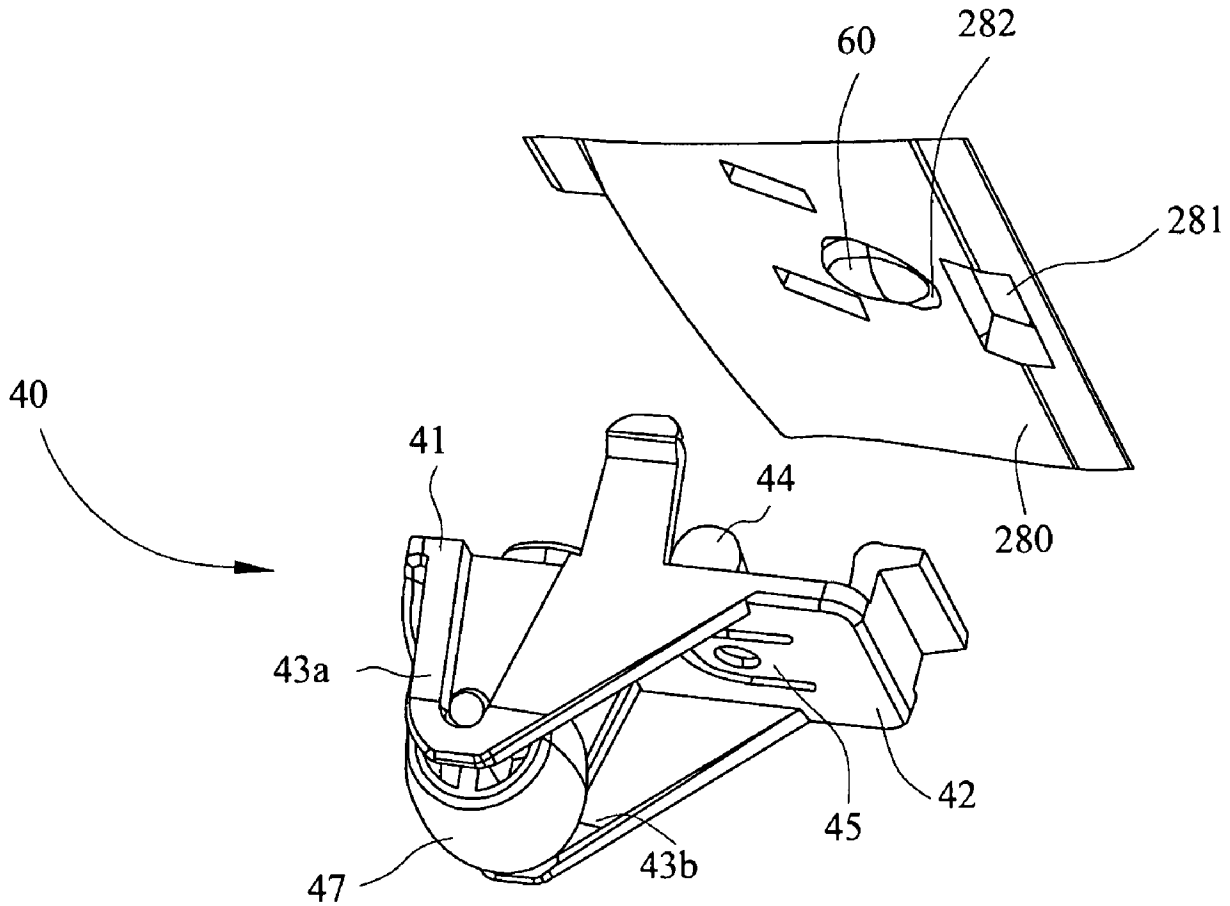
FIG. 5 is an exploded view of FIG. 4.
Figure 6:
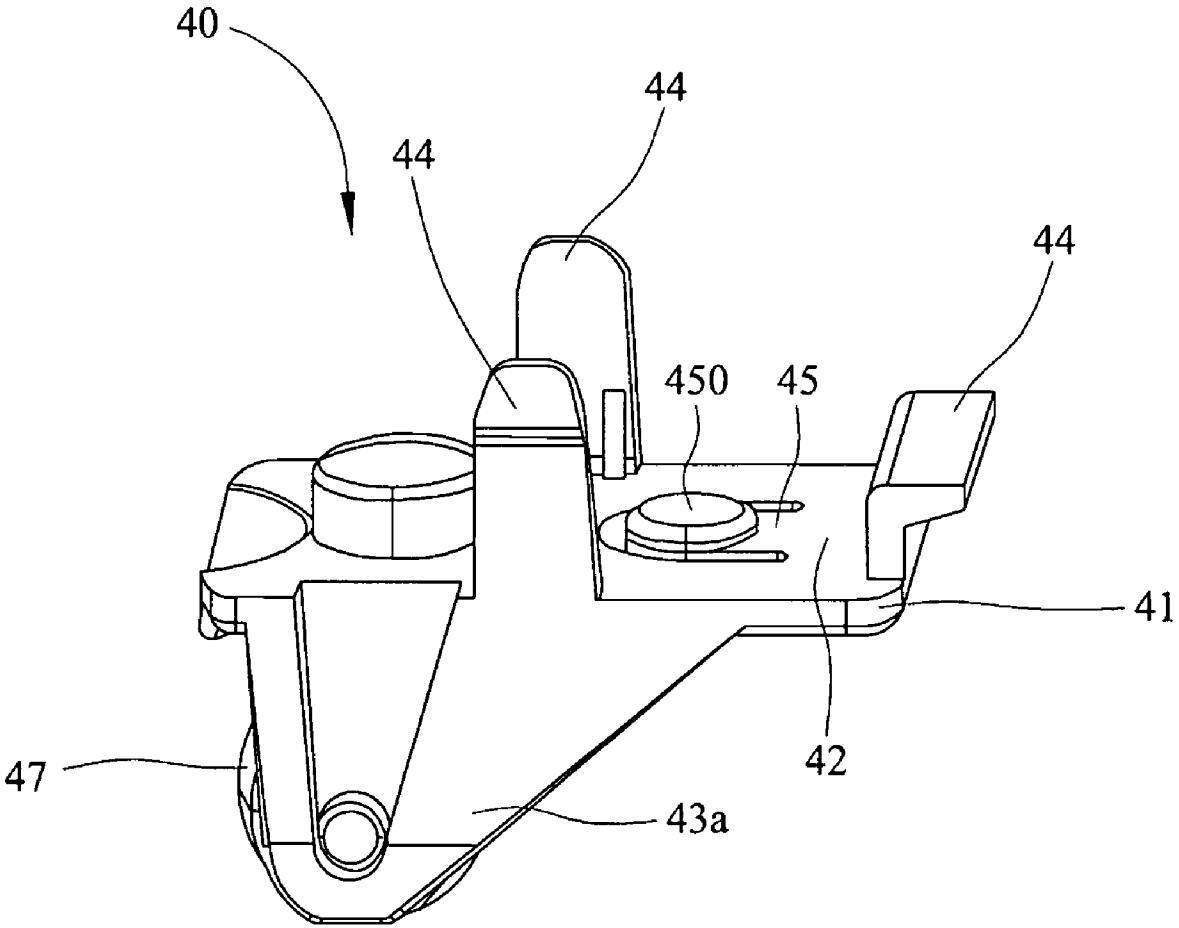
FIG. 6 is a perspective view with another viewpoint of the critical inclination angle sensing unit.
Figure 7:
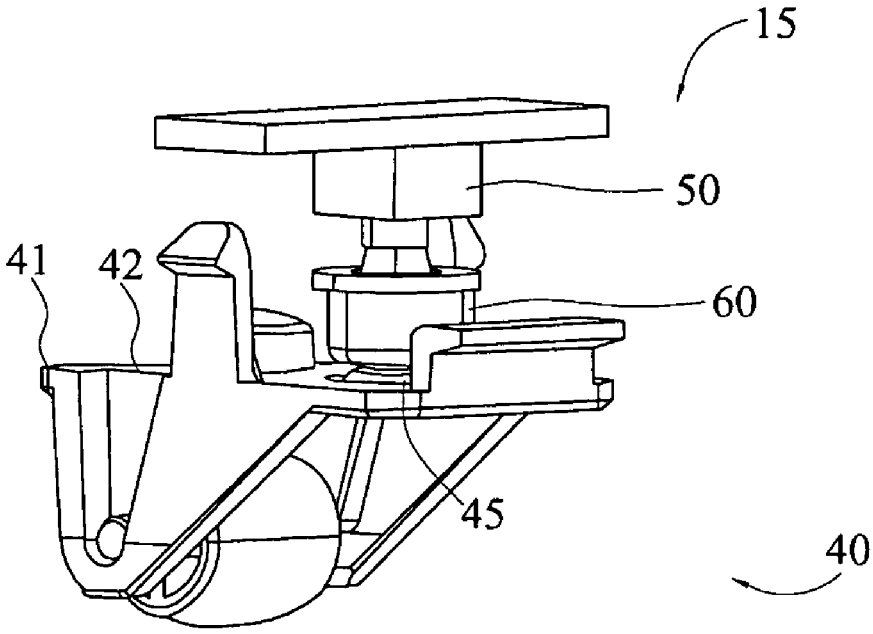
FIG. 7 is an action diagram of the inclination limitation sensing module.
Figure 8:
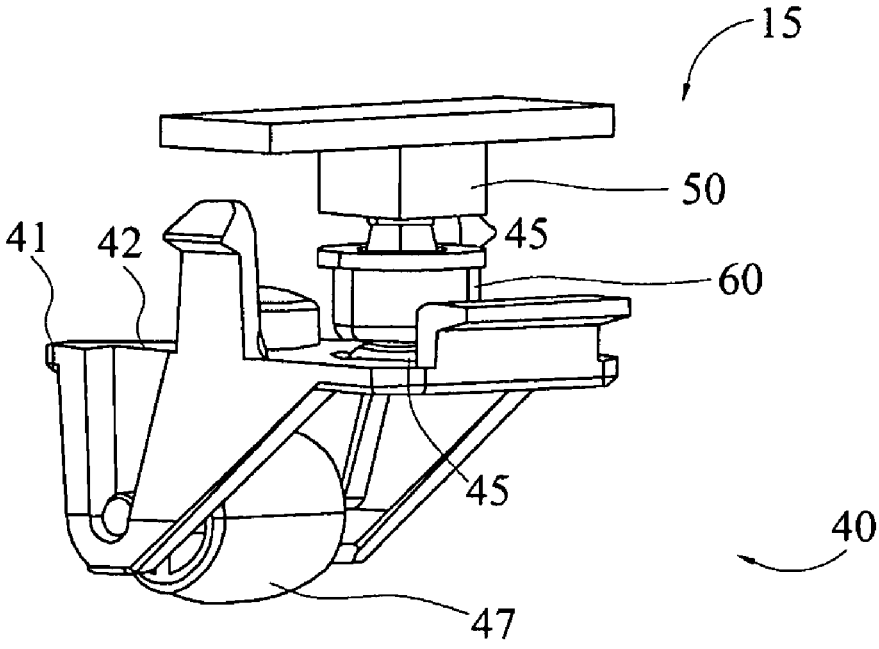
FIG. 8 is an action diagram of the inclination limitation sensing module.

Please reference FIGS. 1 to 8, FIG. 1 is a schematic view showing the system structure of the incline sensing module of the automatic cleaner in accordance with the present invention. FIG. 2 and FIG. 3 are perspective views with different viewpoint of the automatic cleaner. FIG. 4, FIG. 5 and FIG. 6 are enlarged views of a critical inclination angle sensing unit. FIG. 7 and FIG. 8 are action diagrams of an inclination limitation sensing module. The incline sensing module 10 of the present invention is disposed on an automatic cleaner 20.

First, we describe the concise structure of the automatic cleaner 20. The automatic cleaner 20 has a main body 21 which is flat-round-shaped. The main body 21 has a top 22 and a bottom 23, wherein the two opposite ends of the main body 21 are a head portion 27 and a tail portion 28, respectively. A front bumper 24 is disposed on a front periphery of the head portion 27 of the main body 21 for sensing obstacles and controlling between the motion modes in real time. A motor-driven wheel unit 31 and a front wheel 33 are disposed on the bottom 23 of the main body 21. The motor-driven wheel unit 31 drives the automatic cleaner 20. Further, a vacuuming opening 25 and a pair of rotating side brushes are disposed on the bottom 23 for drawing dust, wastes and auxiliary sweeping the floor, respectively.

The incline sensing module 10 includes a control module 11, a motion module 13 and an inclination limitation sensing module 15. The control module 11 is a controlling and processing core of the automatic cleaner 20, wherein the control module 11 controls the operating details of peripheral function elements according to the pre-programming control mode, to complete the function of auto moving and sweeping collaboratively. The motion module 13 is coupled to the control module 11, wherein the control module 11 controls the motion module 13 for driving the motor-driven wheel unit 31 and for steering the movement of the automatic cleaner 20 in mode between a forward mode with the head portion 27 as a head or a backward mode with the tail portion 28 as a head. The front bumper 24 belongs to the moving sensing module for generating a sensing signal and for transferring the sensing signal to the control mode 11, to decide the motion mode of the motion module 13. During operation, the automatic cleaner 20 moves in the forward mode which takes the head portion 27 of the main body 21 as the head and it will change its motion mode into the backward mode when the front bumper 24 detects obstacles.

The inclination limitation sensing module 15 is coupled to the control module 11, and it includes a critical inclination angle sensing unit 40 which is outward disposed on a rear bottom 280 of the main body 21. The distance between the critical inclination angle sensing unit 40 and the bottom 23 is smaller than the distance between the motor-driven wheel unit 31 and the bottom 23. The critical inclination angle sensing unit 40 is suspended when the automatic cleaner 20 moving on the floor horizontally. When the critical inclination angle sensing unit 40 is contacted with the floor as the automatic cleaner 20 is inclined with a critical inclination angle due to climbing a ramp, the inclination limitation sensing module 15 generates a sensing signal and transfers the sensing signal to the control module 11. The control module 11 drives the motion module 13 and switches the motion mode into the backward mode, to reverse the motor-driven wheel unit 31 and to drive the automatic cleaner 20 moving backward.

Furthermore, the inclination limitation sensing module 15 consists of the critical inclination angle sensing unit 40, a switching unit 50 and an actuating element 60. The switching unit 50 is disposed in the main body 21 and is electrically coupled to the control module 11. The actuating element 60 is disposed between the critical inclination angle sensing unit 40 and the switching unit 50. After the critical inclination angle sensing unit 40 pushes the actuating element 60 as being externally contacted, the actuating element 60 further actuates the switching unit 50 to generate a sensing signal and transfer the sensing signal to the control module 11.

In an embodiment of the present invention, the critical inclination angle sensing unit 40 consists of a bracket 41 and an auxiliary wheel 47. The bracket 41 includes a top plate 42, two locating blades 43*a*, 43*b* and a fastener 44. The top plate 42 is substantially a rectangular plate. The fastener 44 includes three slip hooks. The three slip hooks and the two locating blades 43*a*, 43*b* are disposed on the opposite surface of the top plate 42, and extend to opposite directions. The auxiliary wheel 47 is pivotally connected to the locating blades 43*a*, 43*b*. The auxiliary wheel 47 and the fastener 44 are disposed on the different sides of the top plate 42.

The rear bottom 280 of the main body 21 is openly equipped with an assembly port 281 and an opening 282. The assembly port 281 includes three assembly holes, for assembling the fastener 44 of the critical inclination angle sensing unit 40. The critical inclination angle sensing unit 40 is a modular structure which may be assembled or disassembled for any certain situations. Therefore, Users may install the critical inclination angle sensing unit 40 on the main body 21 according to their practical demands, to allow the automatic cleaner 20 with the sensing escaping function.

The actuating element 60 is outward disposed on the opening 282, which is disposed on the rear bottom 280 of the main body 21. An elastic element 45 is disposed on the top plate 42 of the bracket 41, wherein a finger-shaped plate disposed on the top plate 42 forms the elastic element 45. A convex cover 450 is disposed on the elastic element 45. After the critical inclination angle sensing unit 40 is assembled on the main body 21, the convex cover 450 of the elastic element 45 exactly faces the actuating element 60, which is exposed to the rear bottom 280. When the auxiliary wheel 47 is externally contacted, it will lead the top plate 42 to move upwardly, to make the convex cover 450, which is disposed on the elastic element 45, push the actuating element 60, and thus the actuating element 60 presses the switching unit 50. Specifically, the pushing force of the elastic element 45 is buffered due to the elasticity of the elastic element 45. When the top plate 42 applies a force upwardly, the elastic element 45 will be emerged into the top plate 42 slightly after reaching the actuating element 60, to prevent the top plate 42 from applying an excessive force on the actuating element 60, and to avoid the damage of the switching unit 50.

To be more specifically, the description and drawings of the present invention are to elaborate the technical features disclosed by the present invention, and therefore the technical features that are irrelevant to the present invention will not be elaborated.

Figure 9:
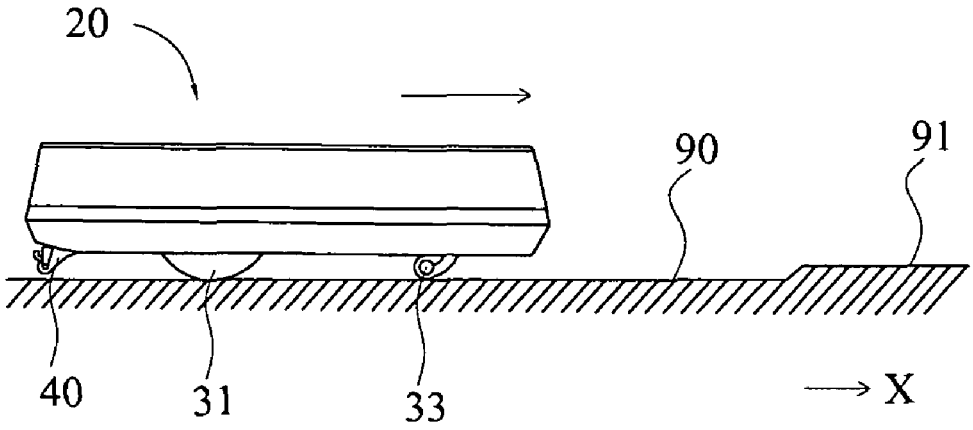
FIG. 9 is an action diagram for sensing and escaping of the automatic cleaner.
Figure 10:
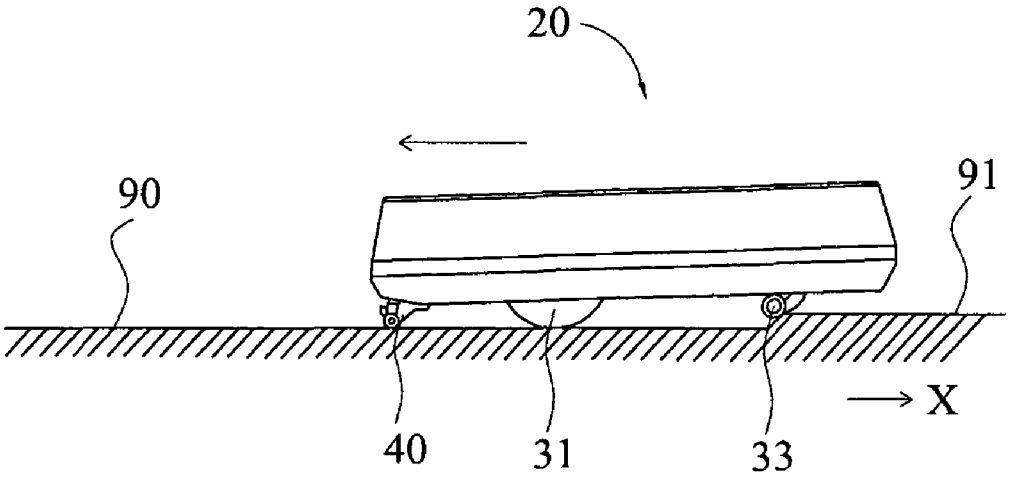
FIG. 10 is an action diagram for sensing and escaping of the automatic cleaner.

Finally, we summarize in view of the description and drawings of incline sensing module of the automatic cleaner 20. Please referring to FIG. 9 and FIG. 10, as shown, the automatic cleaner 20 moves on the floor 90 in a direction X as in the forward mode. When encountering a low stair 91 with ramp, the front wheel 33 will climb over the low stair 91 due to the driving of the motor-driven wheel unit 31, to result the automatic cleaner 20 being inclined. When the critical inclination angle sensing unit 40 is externally contacted with the floor 90, the automatic cleaner 20 activates the backward mode immediately, to reverse the motor-driven wheel unit 31, to make the automatic cleaner 20 move backward from the direction X, as being departed from the low stair 91.

From the above, the incline sensing module of the automatic cleaner of the present invention disposes the critical inclination angle sensing unit on the rear bottom of the main body, for making the automatic cleaner move backward immediately when climbing a ramp, to prevent from misjudging actions such as the suspension of the motor-driven wheel unit, or from being unable to return to the original floor when climbing across a ramp, to make the automatic cleaner operate smoothly. Furthermore, the critical inclination angle sensing unit is assembled or disassembled on the main body determined by the user. Users may allow the automatic cleaner with a sensing escaping function or not according to their practical demands, which allows the automatic cleaner more flexible.

The forgoing descriptions of the embodiments and their accompanying drawings of the present invention are intended to illustrate and not to limit the present invention. Various changes and modifications may be made to the embodiments without departing from the spirit of the invention. Therefore, the scope of the present invention is to be limited only by the appended claims.

I claim:

1. An incline sensing module of an automatic cleaner, disposed on a main body of the automatic cleaner, wherein the opposite ends of the main body are defined as a head portion and a tail portion; the sensing escape device of an automatic cleaner including:

a control module;

a motion module, which is coupled to the control module, where the motion module is equipped with a motor-driven wheel unit, disposed on a bottom of the main body, for controlling the movement of the automatic cleaner in mode between a forward mode taking the head portion as a head or a backward mode taking the tail portion as a head; and an inclination limitation sensing module, coupled to the control module, where the inclination limitation sensing module includes a critical inclination angle sensing unit and an actuating element, which are outward disposed on a rear bottom of the main body, wherein the critical inclination angle sensing unit includes:

a bracket, including a top plate, a fastener and two locating blades, wherein the fastener and the two locating blades are disposed on the opposite surface of the top plate, the fastener is assembled on the main body, and the top plate faces the actuating element exactly; and an auxiliary wheel, which is pivotally connected to the two locating blades, wherein the top plate pushes the actuating element when the auxiliary wheel is externally contacted, wherein the distance between the critical inclination angle sensing unit and the bottom of the main body is smaller than the distance between the motor-driven wheel unit and the bottom of the main body, and the inclination limitation sensing module generating a signal and transferring the signal to the control module when the critical inclination angle sensing unit is externally contacted, to make the control module drive the motion module and to switch into the backward mode.

2. The incline sensing module of an automatic cleaner as claimed in claim 1, wherein the rear bottom of the main body is equipped with a assembly port, the structure of the fastener and the structure of the assembly port are fitted with each other, and it allows the critical inclination angle sensing unit to be assembled or disassembled on the main body.

3. The incline sensing module of an automatic cleaner as claimed in claim 1, wherein the inclination limitation sensing module further includes: a switching unit, which is disposed in the main body and is electrically coupled to the control module, wherein the critical inclination angle sensing unit pushes the actuating element when being externally contacted, and the actuating element actuate the switching unit for making the switching unit generate a sensing signal and transfer the sensing signal to the control module.

4. The incline sensing module of an automatic cleaner as claimed in claim 1, wherein the actuating element disposed outward on the rear bottom of the main body is disposed between the critical inclination angle sensing unit and the switching unit.

5. The incline sensing module of an automatic cleaner as claimed in claim 1, wherein an elastic element, in a shape of finger-shaped plate, is disposed on the top plate, a convex cover is disposed on the elastic element, and the elastic element faces the actuating element exactly, in order to push the actuating element elastically when the auxiliary wheel is externally contacted.

6. The incline sensing module of an automatic cleaner as claimed in claim 5, wherein the top plate is substantially a rectangular plate, and the auxiliary wheel and the slip hook are disposed on the different sides of the top plate.

7. The incline sensing module of an automatic cleaner as claimed in claim 1, wherein the fastener includes at least a slip hook, at least an assembly hole for receiving the slip hook is disposed on the main body, to allow the critical inclination angle sensing unit be assembled on the main body.

* * * * *